United States Patent [19]

Swanson et al.

[11] Patent Number: 4,692,734

[45] Date of Patent: Sep. 8, 1987

[54] INTERRUPTING DEVICE WITH IMPROVED CURRENT-LIMITING ARRANGEMENT

[75] Inventors: Roy T. Swanson, Riverside; Leonard V. Chabala, Maywood; Hiram S. Jackson, Glenview, all of Ill.

[73] Assignee: S&C Electric Company, Chicago, Ill.

[21] Appl. No.: 888,560

[22] Filed: Jul. 21, 1986

[51] Int. Cl.[4] ..... H01H 85/04; H01H 85/12

[52] U.S. Cl. ..... 337/162; 337/159; 337/293

[58] Field of Search ..... 337/162, 161, 160, 159, 337/158, 293

[56] References Cited

U.S. PATENT DOCUMENTS

| | | | |
|---|---|---|---|
| 2,833,891 | 5/1958 | Jacobs | 200/131 |
| 2,866,040 | 12/1958 | Skeats | 200/131 |
| 3,863,187 | 1/1975 | Mahieu et al. | 337/162 |
| 3,909,766 | 9/1975 | Cameron et al. | 337/159 |
| 4,123,738 | 10/1978 | Huber | 337/159 |
| 4,146,863 | 3/1979 | Mollenhoff | 337/296 |
| 4,150,354 | 4/1979 | Namitokov et al. | 337/290 |
| 4,204,184 | 5/1980 | Csizy et al. | 337/295 |
| 4,219,794 | 8/1980 | Arikawa et al. | 337/292 |
| 4,227,167 | 10/1980 | Kozacka et al. | 337/161 |
| 4,227,168 | 10/1980 | Knapp | 337/161 |
| 4,359,708 | 11/1982 | Jarosz et al. | 337/159 |
| 4,467,307 | 8/1984 | Jackson | 337/30 |
| 4,481,495 | 11/1984 | Jarosz et al. | 337/159 |

FOREIGN PATENT DOCUMENTS

| | | |
|---|---|---|
| 1001698 | 12/1976 | Canada . |
| 1010483 | 5/1977 | Canada . |
| 1193154 | 3/1965 | Fed. Rep. of Germany . |

*Primary Examiner*—Harold Broome

*Attorney, Agent, or Firm*—James V. Lapacek

[57] ABSTRACT

An improved current-limiting section is provided for an interrupting device. A main-current-path section of the interrupting device carries substantially all of the normal, load current while only a negligible portion of the current flows through a higher-impedance current-limiting section. Upon operation of the interrupting device, the contacts of a switch in the main-current section are rapidly separated to create one or more gaps. Upon the creation of the one or more gaps, the current is transferred into the current-limiting section. The current-limiting section includes a plurality of fusible elements. The fusible elements are thin, elongated, conductive ribbons. One or more of the fusible elements has a first predetermined pattern of reduced cross-sectional areas that is different than a second predetermined pattern of reduced cross-sectional areas provided in the one or more remaining fusible elements such that for low overcurrent conditions, the one or more fusible elements having the second predetermined pattern melt and have gaps created therein at an earlier time than the one or more fusible elements having the first predetermined patterns. At high overcurrent conditions, the melting characteristics of the fusible elements having the first predetermined pattern and the melting characteristics of the fusible elements having the second predetermined pattern are substantially equal.

20 Claims, 8 Drawing Figures

INTERRUPTING DEVICE WITH IMPROVED CURRENT-LIMITING ARRANGEMENT

BACKGROUND OF THE INVENTION

1. Field of the Invention

The present invention relates to an improved interrupting device or interrupter and an improved current-limiting arrangement that enables the transfer of current from a main-current-path section into a current-limiting section comprising a plurality of fusible elements. The present invention is an improvement over the arrangements disclosed and claimed in the following, commonly assigned U.S. Pat. Nos.: 4,359,708; 4,481,495; and 4,467,307.

2. Description of the Related Art

The aforementioned U.S. Pat. Nos. 4,359,708 and 4,481,495 are directed to high-voltage interrupting devices and current-limiting fuses. As discussed in those patents, the fusible elements disclosed therein are suitable for use in parallel with the main current path of an interrupting device; one or more fusible elements comprising the current-limiting section of the interrupting device. An interrupting module utilizing one or more of the fusible elements of the aforementioned patents and a main-current-path section including a switch are disclosed in the aforementioned U.S. Pat. No. 4,467,307. The interrupting device as shown in U.S. Pat. No. 4,467,307 may include a common housing for the main-current-path section and the one or more fusible elements; the one or more fusible elements being intimately surrounded by compacted fulgurite-forming medium such as silica or sand. The main-current-path section has a high continuous current rating and is designed to carry much higher continuous currents than the current-limiting section. The impedance of the main current path is much lower than the impedance of the current-limiting section so that under normal conditions, with the main current path closed, the main current path carries substantially all the current with only a negligible portion of the current flowing through the one or more fusible elements of the current-limiting section. When an overcurrent condition exists, the switch in the main-current-path section is operated to thereby create one or more gaps in the main current path. Upon the creation of the one or more gaps, the current then commutates or transfers to the current-limiting section whereupon the one or more fusible elements melt and interrupt the current according to well-known principles.

The fusible element in U.S. Pat. No. 4,359,708 includes spaced groups of holes with the separation between adjacent holes within each group being substantially less that the separation between adjacent groups of holes. This arrangement provides for suitable control of the rate of rise of the arc or back voltage after the fusible element has been completely burnt back in the area between the individual holes within each group of holes; burn-back or melting of the fusible element thereafter continuing between the groups.

The fusible element of U.S. Pat. No. 4,481,495 also includes groups of holes or notches with the width of the fusible element being greater between the groups of holes or notches. Accordingly, the fusible element of the patent makes use of the merged arcs within the groups of holes or notches as in the U.S. Pat. No. 4,359,708. Further, after the arcs have merged within the group, the rate of burn back of the ribbon is further slowed due to the decrease in current density in the element at the wider regions. Accordingly, the back voltage across the device is prevented from exceeding a selected value.

The interrupting device, for example, as disclosed in U.S. Pat. No. 4,467,307, is required to transfer or commutate high currents from the main current path to the one or more fusible elements of the current-limiting section. Specifically, the maximum instantaneous current that can be transferred into the one or more fusible elements can be a limiting factor regarding the maximum interrupting capability of the interrupting device and the capability to interrupt high-frequency currents. For suitable operation of the interrupting device at higher operating voltages, the length of the fusible elements and the components of the main current path are increased. Accordingly, the rapid transfer of current to the one or more fusible elements is adversely affected due to the increase of the impedance of the one or more fusible elements and the reduced velocity of the movable portion of the switch in the main-current-path section. Of course, if melting of one or more of the fusible elements takes place before the transfer of current from the main current path to the current-limiting section is complete, successful interruption may not be accomplished.

Arrangements to improve the transfer of current from the main current path to the one or more fusible elements are disclosed and claimed in copending, commonly assigned U.S. application Ser. Nos. 791,178 and 810,792 filed in the name of Roy T. Swanson. The application Ser. No. 810,792 includes first and second contacts arranged in telescoping fashion such that, upon rapid movement of the first contact relative to the second contact, there is a delay in the creation of the gap to allow the movable contact to accelerate to desirably high velocities before significant arc voltages are generated by the creation of the gap. In the application Ser. No. 791,178, energy absorbing means, such as a member fabricated from arc-extinguishing material, is provided between an insulative piston and a movable contact; the piston being arranged to be moved at high speeds to drive the movable contact through the energy-absorbing member thereby preventing undesirable dynamic interactions and rebounding between the piston and the movable contact.

Either as an alternative to or as an extension of the arrangements in these co-pending applications, to alleviate the difficulties encountered with increasing voltage ratings related to the transfer of current from the main current path to the fusible elements, the melting time of the fusible elements can be increased such that higher heating effects of the current ($I^2t$) are required before the fusible elements melt. The increase in the $I^2$ characteristic of the fusible elements can be achieved by using thicker or wider fusible elements or by increasing the number of fusible elements in the current-limiting section of the interrupting device. Increasing the melting $I^2t$ of the fusible elements provides additional time for the transfer of current from the main current path to the current-limiting section before melting takes place.

While the increase in melting $I^2t$ of the fusible elements allows additional time for the transfer of high currents from the main current path to the current-limiting section before the melting of any of the fusible elements, the minimum current that will melt the one or more fusible elements to accomplish interruption is also increased. Additionally, at low overcurrents, the time that is required to melt the fusible elements will also be similarily increased. Accordingly, increasing the $I^2t$ to melt the fusible elements by increasing the number of fusible elements, or by using thicker or wider fusible elements, increases the minimum current that can be cleared or interrupted by the interrupting device—absent specific facilities or instrumentalities to counter the increase in the minimum clearing current.

Fusible elements including various patterns of holes or notches and/or having various cross-sectional geometries or structure are also shown in the following: U.S. Pat. Nos. 2,833,891; 2,866,040; 3,863,187; 3,909,766; 4,123,738; 4,146,863; 4,150,354; 4,219,794; 4,204,184; 4,227,167; and 4,227,168; German publication No. 1,193,154; Canadian Pat. No. 1,001,698; and Canadian Pat. No. 1,010,483.

The aforementioned U.S. Pat. No. 4,123,738 in the Summary of the Invention thereof recites a current-limiting fuse including a main fusible element with an "M" spot (body of low melting temperature alloy) adjacent thereto, and an auxiliary fusible element across the main fusible element. The current-limiting fuse is stated to include elements for significantly reducing the arcing time required to clear low-magnitude fault currents without appreciably affecting the minimum melting $I^2t$ value, the time-current curve, or the $I^2t$ let-through of the fuse. As shown in FIG. 3 of the U.S. Pat. No. 4,123,738, the main fusible element 38 includes a reduced section 40 at the "M" spot and reduced sections 42 and 44 at the portions at which the ends of the auxiliary fusible element 30 are connected through respective arc-gap electrodes 34,36. The sections 46, 48, 50 and 52 of the main fusible element 38 between the reduced sections 40, 42 and 44 include a plurality of uniformly-spaced circular perforations 26 to define fusion points of minimum cross-sectional areas along the fusible element 38. For small but prolonged overload currents, the fusible element 38 melts first at the "M" spot 28 (FIG. 4*b* of U.S. Pat. No. 4,123,738). Due to the reduced portion 40, the fusible element 38 burns back at a much faster rate than the conventional fuse element 14 of FIG. 1 of the U.S. Pat. No. 4,123,738 which is depicted as being of uniform width and as having uniformly-spaced circular perforations 26. As the arc voltage across the auxiliary element exceeds a given value, the gaps 34,36 spark over and current is diverted to the auxiliary fuse element 30 (FIG. 4*c* of U.S. Pat. No. 4,123,738). The arc across the "M"-spot portion of the fusible element 38 extinguishes and the fulgurite about the portion 40 cools. The intensive heat of the arcs at arc-gap electrodes 34,36 quickly burns open the reduced sections 42,44 (FIG. 4*d* of U.S. Pat. No. 4,123,738); the rate of burn back at the reduced portions 42 and 44 being higher than the rate of the conventional fusible element 14. When the auxiliary element 30 vaporizes (FIG. 4*e* of U.S. Pat. No. 4,123,738), the circuit is interrupted. For high magnitude fault currents, the reduced portions 40, 42 and 44 and the fusion points of the sections 46, 48, 50 and 52 are stated to vaporize almost instantaneously. While the arrangement of the U.S. Pat. No. 4,123,738) is alleged to provide desirable results, the manufacture thereof for consistent operation would appear to be rather complex as requiring a main fusible element of reduced crosssectional areas, an "M" spot, an auxiliary element formed by a fusible wire, and the arc-gap electrodes 34, 36. Although it is somewhat unclear, the U.S. Pat. No. 4,123,738 appears to utilize two main fusible ribbons 14 or 38 to provide the main fusible element 12 of the fuse 10. Similarly, two fusible wires 32 comprise the auxiliary fusible element 30.

While the aforementioned arrangements may be generally suitable for their intended use, it would be advantageous to provide an interrupting device with an improved and easily manufacturable current-limiting section so as to enable the transfer of higher currents from the main current path of the interrupting device into the current-limiting section without substantially affecting the minimum current that can be cleared or interrupted by the current-limiting section.

SUMMARY OF THE INVENTION

Accordingly, it is a principal object of the present invention to provide an improved interrupting device having an improved current-limiting section for providing the transfer of higher currents from a main current path of the interrupting device into a current-limiting section while not substantially increasing the minimum current that can be cleared or interrupted by the current-limiting section.

It is another object of the present invention to provide an improved interrupting device having a main-current-path section including a switch which is operable to create one or more gaps in the main-current-path section and the interrupting device further including a current-limiting section connected in parallel with the main-current-path section; the current-limiting section including a plurality of fusible elements, one or more of the fusible elements having holes or notches, the remaining one or more fusible elements having holes or notches that are more elongated than the holes or notches of the one or more fusible elements so as to achieve a desirably wide range of currents that can be interrupted.

These and other objects of the present invention are achieved by providing an improved current-limiting section for an interrupting device to achieve the transfer of higher currents from a main-current-path section of the interrupting device into the current-limiting section which is connected in parallel with the main-current-path section. The transfer of higher currents is achieved without substantially increasing the minimum clearing current. The main-current-path section of the interrupting device carries substantially all of the normal, load current while only a negligible portion of the current flows through the higher-impedance current-limiting section. The main-current-path section includes a switch that is operated upon the occurrence of overcurrent conditions. Upon operation, the contacts of the switch are rapidly separated to create one or more gaps. Upon the creation of the one or more gaps, the current is transferred into the current-limiting section. The current then melts the one or more fusible elements of the current-limiting section in accordance with the melting $I^2t$ characteristics thereof. In one particular interrupting device, the main-current-path section and the current-limiting section are enclosed by a common housing. The current-limiting section includes a plurality of fusible elements. The fusible elements are thin, elongated, conductive ribbons that are disposed about the main-current-path section with the fusible elements being in intimate engagement with a particulate, fulgurite-forming medium contained within the housing. One or more of the fusible elements have a first predetermined pattern of reduced cross-sectional areas that is different than a second predetermined pattern of reduced crosssectional areas provided in the one or more remaining fusible elements such that for low overcurrent conditions, the one or more fusible elements having the second predetermined pattern melt and have gaps created at an earlier time than the one or more fusible elements having the first predetermined pattern. At high overcurrent conditions, the melting characteristics of the fusible elements having the first predetermined pattern and the melting characteristics of the fusible elements having the second predetermined pattern are substantially equal. In a specific arrangement, one or more of the fusible elements include holes of a first type and one or more of the remaining fusible elements include slotted holes of a second type that are elongated along the length of the fusible element as compared to those of the first type. For overcurrents in a low range, when the switch is operated and the current transfers to the fusible elements, the heat buildup in the reduced ribbon portions adjacent the slotted holes of the second type is substantially greater than the heat buildup in the reduced portions adjacent the holes of the first type. Accordingly, the one or more fusible elements with the slotted holes of the second type melt or burn back more quickly than the one or more fusible elements having holes of the first type. Additional current is then commutated from the one or more fusible elements having the slotted holes of the second type into the one or more fusible elements having the holes of the first type thereby decreasing the time to melt and increasing the rate of burn-back therein. Thus, for overcurrents in a low range, since the overall melting time of the fusible elements is shorter than it would be if all the fusible elements had holes of the first type, the minimum clearing current is also lower. At high overcurrents, the melting times of the fusible elements are so short that the difference in heat buildup around the holes of the first type and the slotted holes of the second type is negligible so that all the fusible elements exhibit similar melting times. This arrangement provides suitable arc-voltage characteristics whereas the use of fusible elements which all have slotted holes of the second type makes the transfer of current into the fusible elements more difficult due to the higher impedance and results in unsuitable, undesirably high arc-voltage characteristics; the one or more fusible elements in the arrangement having holes of the first type exhibiting lower arc-voltage characteristics as the fusible element melts as compared to the fusible elements having slotted holes of the second type.

BRIEF DESCRIPTION OF THE DRAWING

The invention, both as to its organization and method of operation, together with further objects and advantages thereof, will best be understood by reference to the accompanying drawing in which.

DETAILED DESCRIPTION OF THE INVENTION

Figure 1:
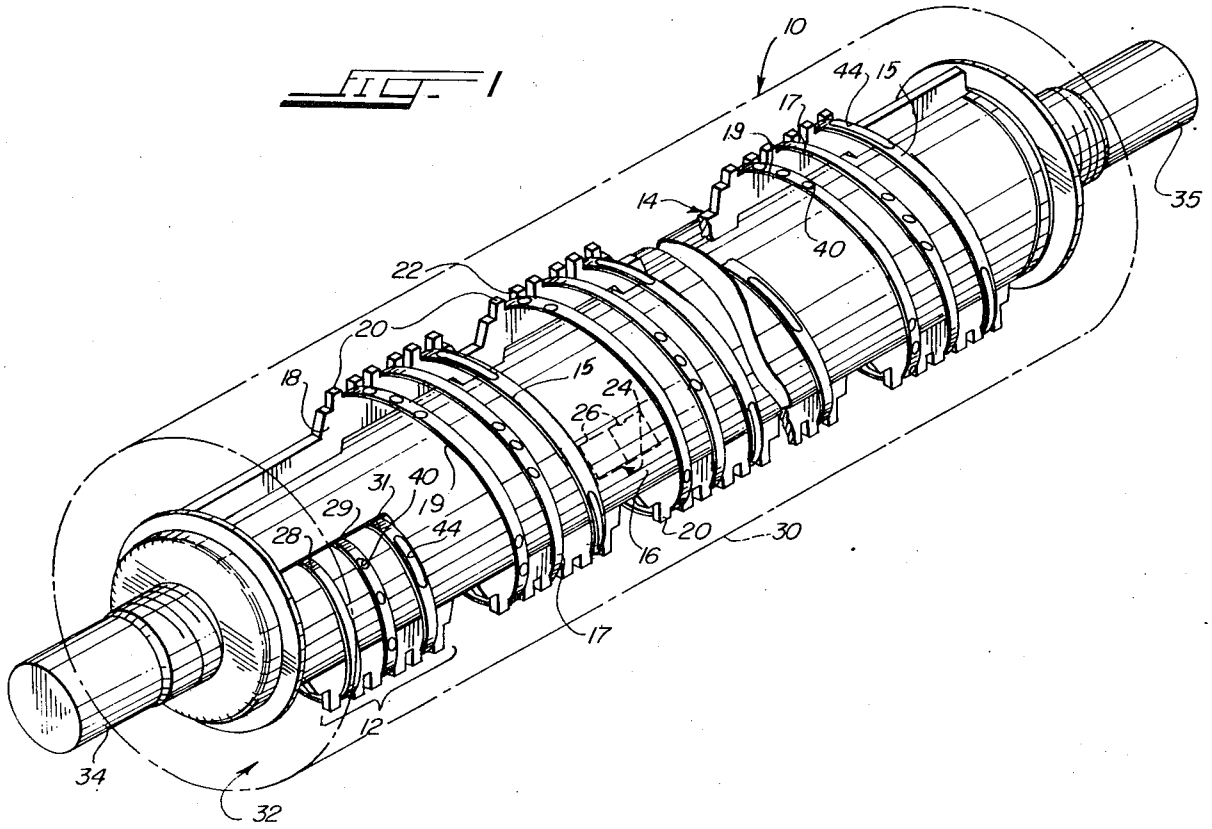
FIG. 1 is a perspective view of a high-voltage interrupting device which includes a current-limiting section according to the present invention.

Referring now to FIG. 1, the interrupting device 10 of the present invention includes a current-limiting section 12. The current-limiting section 12 includes a plurality of fusible elements. For example, in the specific, illustrative embodiment of FIG. 1, the current-limiting section 12 includes three fusible elements 15, 17 and 19. Each of the fusible elements is a thin, elongated conductive ribbon. The fusible elements 15, 17 and 19 are held in a circular, helical configuration by an element support 14. A hollow, insulative cylinder 16 is provided which carries fins 18 of the support 14. The fins 18 include a series of projections 20 having notches 22 about which the fusible elements 15, 17 and 19 are wound.

The interrupting device 10 includes a normally-closed switch that is schematically represented at 24 and that defines a main current path of a main-current-path section. The switch 24 includes one or more pairs of contacts 26 which are relatively movable apart along a fixed line of direction within the cylinder 16. Various portions of the interrupting device 10 are shown only generally, and some portions thereof are shown only in phantom for the sake of clarity. The interrupting device may be generally as described in U.S. Pat. No. 4,467,307 for suitable practice of the present invention. The ends 28, 29 and 31 of the respective fusible elements 15, 17 and 19 are electrically connected in shunt with the contacts 26 by suitable facilities (not shown); for example, as disclosed in the aforementioned U.S. Pat. No. 4,467,307. The interrupting device 10 has a high continuous current rating for which the main current path is designed and the impedance of the main current path through the switch 24 is much lower than the impedance of the current-limiting section 12. Accordingly, with the contacts 26 closed, substantially all of the current flows through the switch 24 while only a negligible portion of the current flows through the current-limiting section 12. In response to an overcurrent condition, the switch 24 is opened by rapidly separating the contacts 26 whereupon the current is commutated or transferred from the main current path to the current-limiting section 12.

The interrupting device 10, in the specific, illustrative embodiment of FIG. 1, includes an outer housing 30 of insulating material which defines a volume 32 with the cylinder 16; the volume 32 being filled with a fulgarite-forming medium (not shown) such as silica sand or quartz. When the current is transferred to the current-limiting section 12, the fusible elements 15, 17 and 19 and the medium co-act, as is well known, to interrupt the current in a current-limiting or energy-limiting manner. The interrupting device 10 is mountable and electrically connectable into an electrical circuit (not shown) by end terminals 34,35 which may protrude beyond the ends of the cylinder 16 and the housing 30. Each of the terminals 34,35 is electrically connected to a respective end 28, 29 and 31 of the fusible elements 15, 17 and 19 and a respective contact 26 in any convenient manner.

In accordance with important aspects of the present invention, one or more of the fusible elements of the current-limiting section 12 includes a first predetermined pattern of holes of a first type or geometry and the one or more remaining fusible elements includes a second predetermined pattern of holes of a second type or geometry. With this arrangement, the interrupting device 10, while also being capable of transferring higher currents from the main current path to the current-limiting section 12, provides a minimum clearing current that is desirably low while also being capable of transferring higher current from the main current path to the current-limiting section 12. For example, for suitable operation of the interrupting device 10 at higher operating voltages, the length of the fusible elements and the components of the switch 26 are increased. Accordingly, the transfer of current from the main current path to the current-limiting section 12 is adversely affected due to an increase in the impedance of the fusible element and the reduced velocity of the movable portions of the switch 24. The melting time of the fusible elements of the current-limiting section 12 can be increased such that higher heating effects of the current ($I^2t$) are required before the fusible elements melt, thus allowing more time for the transfer of the current. However, if the melting $I^2t$ of the fusible elements of the current-limiting section 12 is increased by increasing the number of fusible elements or by using fusible elements of larger cross section, the minimum clearing current is also increased as is the minimum current to melt the fusible elements. On the other hand, if all fusible elements such as 15 are utilized, the transfer of current to the fusible element is adversely affected due to the higher impedance of the fusible elements and the arc-voltage characteristics are undesirably high.

In accordance with the current-limiting section 12 of the present invention, at least one of the plurality of fusible elements of the current-limiting section 12, for example fusible element 15, is provided with a pattern of holes that causes the fusible element 15 to exhibit a shorter melting time at low current than one or more of the remaining fusible elements. Specifically, and referring additionally now to FIGS. 2 and 3, if the fusible element 17 is provided with a pattern of holes 40 of a first type, the fusible element 15 is provided with a pattern of slotted holes 44 of a second type. The fusible element 19 may then be provided with a pattern of holes of either the first or second type or a different type as will be discussed in more detail hereinafter. In the illustrative specific embodiment of FIG. 1, the fusible element 19 is identical to the fusible element 17 and is provided with a pattern of holes 40 of the first type. In any case, at low currents, the one or more fusible elements (e.g. 15) with the pattern of holes of the second type melts first which then causes additional current to flow through the remaining one or more fusible elements (e.g. 17,19) having the pattern of holes of the first type.

Figure 2:
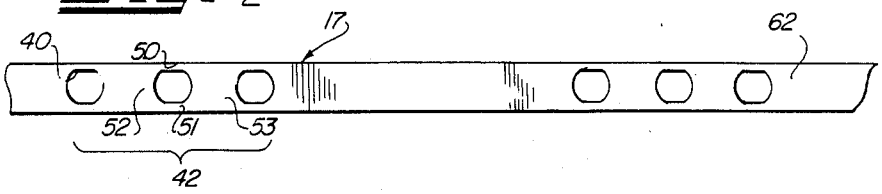
FIGS. 2 and 3 are elevational views of respective fusible elements of the current-limiting section of FIG. 1.
Figure 3:
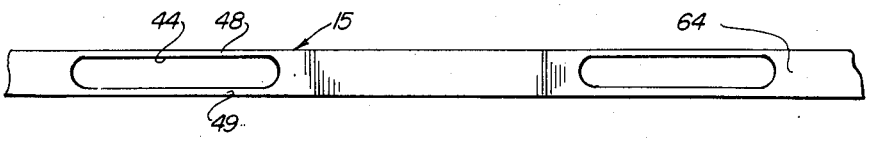
Figure 4:
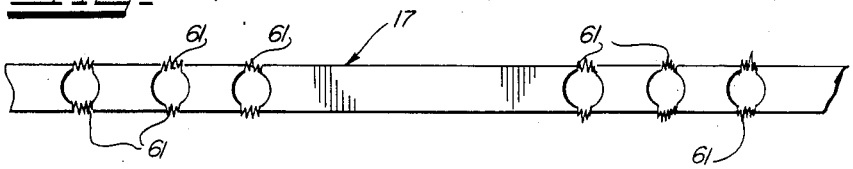
FIGS. 4 and 5 are elevational views depicting the fusible elements of FIGS. 2 and 3 respectively after current has been transferred to the fusible elements and burn back or melting of the fusible elements has begun.
Figure 5:
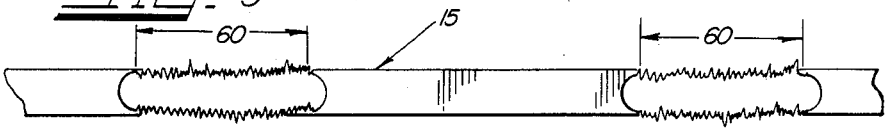

In the specific embodiment illustrated in FIG. 1, the fusible elements 17,19 as best seen in FIG. 2, each include a series of slots or holes 40 of the first type located in serial groups 42, while the fusible element 15, as best seen in FIG. 3, includes a series of slotted or elongated holes 44. At low overcurrents, when the switch 24 is operated and the current is transferred to the current-limiting section 12, the reduced-width sections 48, 49 adjacent the elongated holes 44 of the fusible element 15 are heated more rapidly by the current therethrough than are the corresponding sections 50,51 of the fusible elements 17,19 due to the heat loss or transfer from the sections 50,51 to the adjacent portions 52, 53 of the fusible element 17. The sections 48,49 of the fusible element 15 have greatly increased heat buildup relative to the sections 50,51 of the fusible element 17. Accordingly, the fusible element 15 at the sections 48,49 melts or burns back more rapidly than the sections 50,51 of the fusible elements 17,19. After the sections 48,49 of the fusible element 15 have burned back so as to create gaps 60 as illustrated in FIG. 5 and the fusible elements 17,19 have burned back so as to create gaps 61 illustrated in FIG. 4, additional current is then commutated from the fusible element 15 to the fusible elements 17,19 thereby increasing the rate of burn-back in the fusible elements 17,19. For high levels of overcurrents, the melting times of the fusible elements 15, 17, and 19 are short and substantially equal so that the difference in heat buildup is negligible for each of the portions 48,49 compared to portions 50,51.

Accordingly, the transfer of high currents to the fusible elements 15, 17 and 19 and the melting time thereof at high currents is substantially equal to that for three fusible elements of the type 17. Thus, for overcurrents in a low range, since the overall melting time of the fusible elements 15, 17 and 19 is shorter than it would be if all the fusible elements were of the type 17, the minimum clearing current is also lower. The use of the fusible elements 15, 17 and 19 provides suitable arc-voltage characteristics whereas the use of three fusible elements of the type 15 results in unsuitable, undesirably high arc-voltage characteristics as well as increased difficulty in transferring current into the fusible elements due to the increased impedance of the fusible elements; the fusible elements 17,19 exhibiting lower arc-voltage characteristics as the fusible element melts as compared to fusible elements of the type 15.

In the specific embodiment illustrated in FIGS. 2 and 3, the spacing between groups 42 of the holes 40 is substantially equal to the spacing between the elongated slots 44. Further, the overall expanse of each group 42 is substantially equal to the length of each elongated slot 44. Additionally, the transverse width of the holes 40 and 44 measured across the width of the fusible elements are substantially equal.

Figure 6:
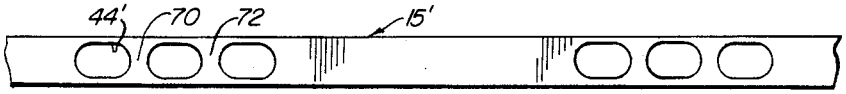
FIG. 6 is an elevational view of an alternate embodiment of the fusible element of FIG. 3.

Referring now to FIG. 6, the fusible element 15' is identical to that of the fusible element 15 of FIG. 3 except that the elongated slots 44' of the fusible element 15' are fabricated with rungs or bridges 70,72 for ease of handling of the fusible elements 15' during manufacture and for increased mechanical strength. However, the melting characteristics of the fusible element 15' are substantially identical to those of the fusible element 15 since the rungs or bridges 70,72 do not significantly change the current density or heat transfer of the sections 48,49.

Figure 7:
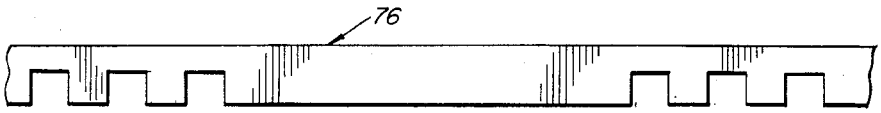
FIGS. 7 and 8 are elevational views of alternate fusible elements.
Figure 8:
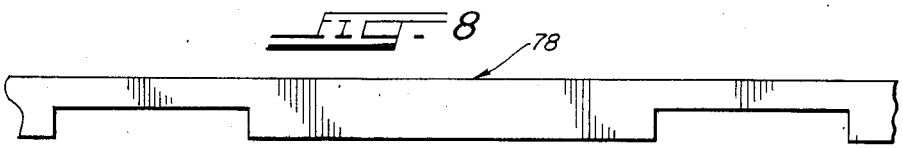

While there have been illustrated and described various embodiments of the present invention, it will be apparent that various changes and modifications will occur to those skilled in the art. For example, while the holes 40 are depicted in FIG. 2 as being generally circular with flattened or straight portions adjacent the sections 50,51 and while the elongated slots or holes 44 are depicted as rectangular with oval ends, it should be realized that the holes may have other shapes or may be replaced by notches; that is regions of any shape formed in or through the fusible elements 15,17. Additionally, while the holes 40 and 44 are illustrated as being generally centered about the respective longitudinal axes 62,64 of the fusible elements 15,17, the holes 40 and 44 need not be so centered. Further, the holes or notches 40,44 need not extend completely through the fusible elements 15,17 but need only effectively reduce the cross-sectional area of the fusible elements 15,17 at the points of formation thereof. The features of the present invention are provided by the melting time of one or more of the fusible elements of the current-limiting section 12 being substantially less at low currents than the one or more remaining fusible elements while the melting time at high currents is substantially the same for all the fusible elements. In the specific embodiment of the current-limiting section 12 of FIG. 1, the fusible element 15 includes elongated slots of the second type while the fusible elements 17,19 include holes of the first type. However, as noted hereinbefore, the desired features of the present invention are achieved by the provision of a pattern of sites of reduced cross-sectional area for one or more of the fusible elements to provide a reduced melting time at low currents compared to one or more of the remaining fusible elements; i.e., the invention can be practiced in specific embodiments with more than two different types of hole geometries and more than two different hole geometries for any of the fusible elements. Additionally, the fusible elements in specific embodiments may incorporate the features depicted in the aforementioned and U.S. Pat. Nos. 4,481,495 and 4,395,708. The use of notches instead of holes is illustrated by the fusible elements 76 and 78 of FIGS. 7 and 8 respectively. Further, while a specific embodiment of the interrupting device 10 has been described for illustrative purposes, it should be realized that many other specific embodiments are also possible for the practice of the present invention utilizing the improved current-limiting section 12. For example, the fusible elements 15,17 need not be helical configurations. It is intended in the appended claims to cover all such changes and modifications as fall within the true spirit and scope of the present invention.

What is claimed and desired to be secured by Letters Patent of the United States is:

1. A current-limiting arrangement for an interrupting device that includes a main current path in parallel with the current-limiting arrangement, the main current path including a switch which is operable to rapidly open the main current path, the current-limiting arrangement comprising:

means comprising a plurality of fusible elements for improving the transfer of high currents from the main current path to the current-limiting arrangement without substantially increasing the minimum current that is interruptable by the current-limiting arrangement, each of said plurality of fusible elements comprising an elongated, thin, conductive ribbon, one or more of said plurality of fusible elements having holes, slots, or notches formed through or in said ribbon and spaced along the length of said ribbon with the length of each of said holes, slots, or notches not exceeding a first predetermined dimension along the length of said ribbon, the remaining one or more of said plurality of fusible elements having holes, slots, or notches formed through or in said ribbon and spaced along the length of said ribbon with the length of each of said holes, slots, or notches being greater than or equal to a second predetermined dimension along the length of said ribbon, said second predetermined dimension being greater than said first predetermined dimension.

2. The current-limiting arrangement of claim 1 wherein said holes, slots, or notches in said plurality of fusible elements are spaced along the length of said ribbons in predetermined patterns.

3. The current-limiting arrangement of claim 1 wherein said holes, slots, or notches of said one or more fusible elements are arranged in groups of two or more holes, slots, or notches; adjacent holes, slots, or notches of each group being separated along the length of said ribbon by a third distance which is substantially less than a fourth distance between adjacent groups along said ribbon.

4. The current-limiting arrangement of claim 3 wherein adjacent holes or notches of said remaining one or more fusible elements are spaced apart by a fifth distance substantially greater than said second predetermined dimension.

5. The current-limiting arrangement of claim 4 wherein said fourth and fifth dimensions are substantially equal.

6. The current-limiting arrangement of claim 3 wherein the length of each of said holes or notches of said remaining one or more fusible elements is substantially equal to said second predetermined dimension and the overall length of each of said groups along each of said ribbons of said one or more fusible elements is substantially equal to said second predetermined dimension.

7. The current-limiting arrangement of claim 1 wherein the width of each of said holes, slots, or notches of said plurality of fusible elements measured across the width of said respective ribbon is a substantial percentage of the width of each of said respective ribbon.

8. The current-limiting arrangement of claim 1 wherein said holes, slots, or notches of said one or more fusible elements have substantially equal width and length dimensions.

9. The current-limiting arrangement of claim 1 wherein said holes, slots, or notches of said remaining one or more fusible elements are slots and have a length dimension along the length of said respective ribbon that is substantially greater than a width dimension generally perpendicular to the length of said respective ribbon.

10. The current-limiting arrangement of claim 9 wherein each of said slots of said remaining one or more fusible elements includes one or more rungs spanning the width of said slot, the overall length of each of said slots being at least an order of magnitude greater than the expanse of each of said rungs along the length of said respective ribbon of said remaining one or more fusible elements, the spacing between adjacent holes, slots, or notches of said one or more fusible elements being substantially greater than the expanse of each of said rungs along the length of said respective ribbon of said remaining one or more fusible elements.

11. The current-limiting arrangement of claim 9 wherein said holes, slots, or notches of said one or more fusible elements are generally circular.

12. The current-limiting arrangement of claim 11 wherein said holes, slots, or notches of said plurality of fusible elements are defined along their respective width dimensions so as to be substantially parallel with the edges of the respective ribbon.

13. The current-limiting arrangement of claim 9 wherein said holes, slots, or notches of said one or more fusible elements are arranged in groups having an overall length along the length of said respective ribbon, each of said slots in said remaining one or more fusible elements having a length substantially equal to the overall length of each of said groups.

14. The current-limiting arrangement of claim 1 wherein each of said ribbons of said plurality of fusible elements includes a width generally perpendicular to the length of said ribbon, the widths of each of said ribbons of said plurality of fusible elements being substantially equal.

15. The current-limiting arrangement of claim 1 wherein each of said ribbons of said plurality of fusible elements has a cross-sectional area that is substantially equal.

16. The current-limiting arrangement of claim 1 wherein each of said holes, slots, or notches in said ribbons of said plurality of fusible elements defines a reduced cross-sectional area of the respective ribbon that is substantially equal.

17. A current-limiting arrangement for an interrupting device that includes a main current path in parallel with the current-limiting arrangement, the main current path including a switch which is operable to rapidly interrupt the current in the main current path in the presence of overcurrents, the current-limiting arrangement comprising:

m fusible elements, where m is greater than 1, each of said m fusible elements comprising an elongated, thin, conductive ribbon, each of said ribbons having a length along said ribbon and a pattern of reduced cross-sectional areas, said m fusible elements comprising means for defining a low-overcurrent melting characteristic such that n of said ribbons exhibit different low-overcurrent melting characteristics than the low-overcurrent melting characteristics of said remaining m-n fusible elements and for defining a high-overcurrent melting characteristic such that said plurality of fusible elements exhibit substantially equal high-overcurrent melting characteristics, where n is one or more, said melting-characteristic-defining means being defined by a first predetermined pattern of reduced cross-sectional areas of said n ribbons and a second predetermined pattern of reduced cross-sectional areas of said remaining m-n ribbons.

18. The current-limiting arrangement of claim 17 wherein said first and second predetermined patterns of reduced cross-sectional areas are defined by holes, slots, or notches formed through or in said ribbons so that predetermined portions of said remaining m-n ribbons adjacent said holes, slots, or notches have less heat buildup as compared to corresponding predetermined portions of said n ribbons.

19. The current-limiting arrangement of claim 17 wherein said first and second predetermined patterns of reduced cross-sectional areas are defined by holes, slots, or notches formed through or in said ribbon, the holes, slots, or notches of each of said m ribbons being of substantially equal width as measured transverse to the length of each of said ribbons, each of said holes, slots, or notches of n ribbons having a length along the length of said ribbon that is substantially greater than the length of each of said holes, slots, or notches of said remaining m-n ribbons.

20. A current-limiting arrangement for an interrupting device that includes a main current path in parallel with the current-limiting arrangement, the main current path including a switch which is operable to rapidly interrupt the current in the main current path in the presence of overcurrents, the current-limiting arrangement comprising:

a plurality of fusible elements, each of said plurality of fusible elements comprising an elongated, thin, conductive ribbon, each of said ribbons having a pattern of reduced cross-sectional areas, said plurality of fusible elements comprising means for defining a low-overcurrent melting characteristic resulting in the melting of portions of one or more of said ribbons to form one or more gaps at an earlier time than the melting of portions of said remining one or more fusible elements to form one or more gaps and for defining a high-overcurrent melting characteristic such that said plurality of fusible elements exhibit substantially equal high-overcurrent melting characteristics.

* * * * *